US005645100A

United States Patent [19]

Chuang et al.

[11] Patent Number: 5,645,100

[45] Date of Patent: Jul. 8, 1997

[54] HAND PUMP FOR ENGAGING WITH DIFFERENT TIRE VALVES

[76] Inventors: Louis Chuang, No. 7th Floor-8, No. 20, Ta Lon Road, Taichung, Taiwan; Scott Wu, No. 2, Lane 296, Ming Sheng Road, Wu Feng Hsiang, Taichung, Taiwan

[21] Appl. No.: 509,242

[22] Filed: Jul. 31, 1995

[51] Int. Cl.[6] ..... F16K 15/20; F16K 11/07

[52] U.S. Cl. ..... 137/223; 137/625.5; 251/259

[58] Field of Search ..... 137/223, 625.5, 137/867; 251/259

[56] References Cited

U.S. PATENT DOCUMENTS

| | | | |
|---|---|---|---|
| 1,789,306 | 1/1931 | Ewald | 137/223 |
| 1,838,166 | 12/1931 | Wahl | 137/223 |
| 1,860,888 | 5/1932 | Crowley | 137/223 |
| 1,918,689 | 7/1933 | Crowley | 137/223 |
| 2,662,721 | 12/1953 | Giauque | 137/625.5 X |
| 2,847,028 | 8/1958 | Ross | 137/867 |
| 2,880,747 | 5/1959 | Newcomb | 137/223 |
| 3,369,564 | 2/1968 | Puccinelli et al. | 251/259 |
| 3,572,384 | 3/1971 | Taylor | 137/625.5 |

FOREIGN PATENT DOCUMENTS

| | | | |
|---|---|---|---|
| 655983 | 5/1986 | Switzerland | 137/223 |
| 532760 | 1/1941 | United Kingdom | 137/223 |
| 548165 | 9/1942 | United Kingdom | 137/223 |
| 548787 | 10/1942 | United Kingdom | 137/223 |

*Primary Examiner*—John Rivell
*Attorney, Agent, or Firm*—Charles E. Baxley, Esq.

[57] ABSTRACT

A hand pump for engaging with different tire valves includes a pipe laterally secured on top of a tube for receiving two gaskets and a plug member. The pipe includes two valve seats. The plug member includes two plug portions for engaging with the valve seats of the pipe so as to seal the valve seats. A handle is pivotally coupled to the pipe and has a cam engaged in the plug member so as to move the plug member and so as to engage the plug portions with the valve seats. The gaskets may be engage with different tire valves.

5 Claims, 3 Drawing Sheets

HAND PUMP FOR ENGAGING WITH DIFFERENT TIRE VALVES

BACKGROUND OF THE INVENTION

1. Field of the Invention

The present invention relates to a hand pump, and more particularly to a hand pump for pumping different tire valves.

2. Description of the Prior Art

Typical hand pumps for tire valves comprise a cylinder having a handle for pumping a piston which is slidably engaged in the cylinder. However, the hand pumps each includes an attachment member that is good for engaging with a specific type of tire valve and which is not suitable for engaging with different tire valves.

The present invention has arisen to mitigate and/or obviate the afore-described disadvantages of the conventional hand pump attachment members.

SUMMARY OF THE INVENTION

The primary objective of the present invention is to provide a hand pump which may be used for engaging with different tire valves.

In accordance with one aspect of the invention, there is provided a hand pump for engaging with different tire valves comprising a tube including an upper portion having a pipe laterally secured thereon so as to form a T-shaped configuration, the pipe including two end portions, the pipe including two valve seats formed therein, two caps secured to the end portions of the pipe, the caps each including an opening formed therein for engaging with the tire valves, two gaskets engaged in the end portions of the pipe, a plug means slidably engaged in the pipe and engaged between the gaskets, the plug means including two plug portions for engaging with the valve seats of the pipe, and cam means for moving the plug means so as to engage the plug portions with the valve seats.

The plug means includes two ends each having an enlarged head portion formed thereon, the plug portions are formed between the head portions and the plug means.

The head portions each includes an orifice formed therein for allowing air to flow therethrough.

The plug means includes a chamber formed therein, the cam means is engaged in the chamber.

A handle includes a first end having a shaft laterally extended therefrom for rotatably engaging with the pipe, the cam means is secured to the shaft and is engaged in the chamber so as to move the plug means when the handle is rotated about the shaft.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
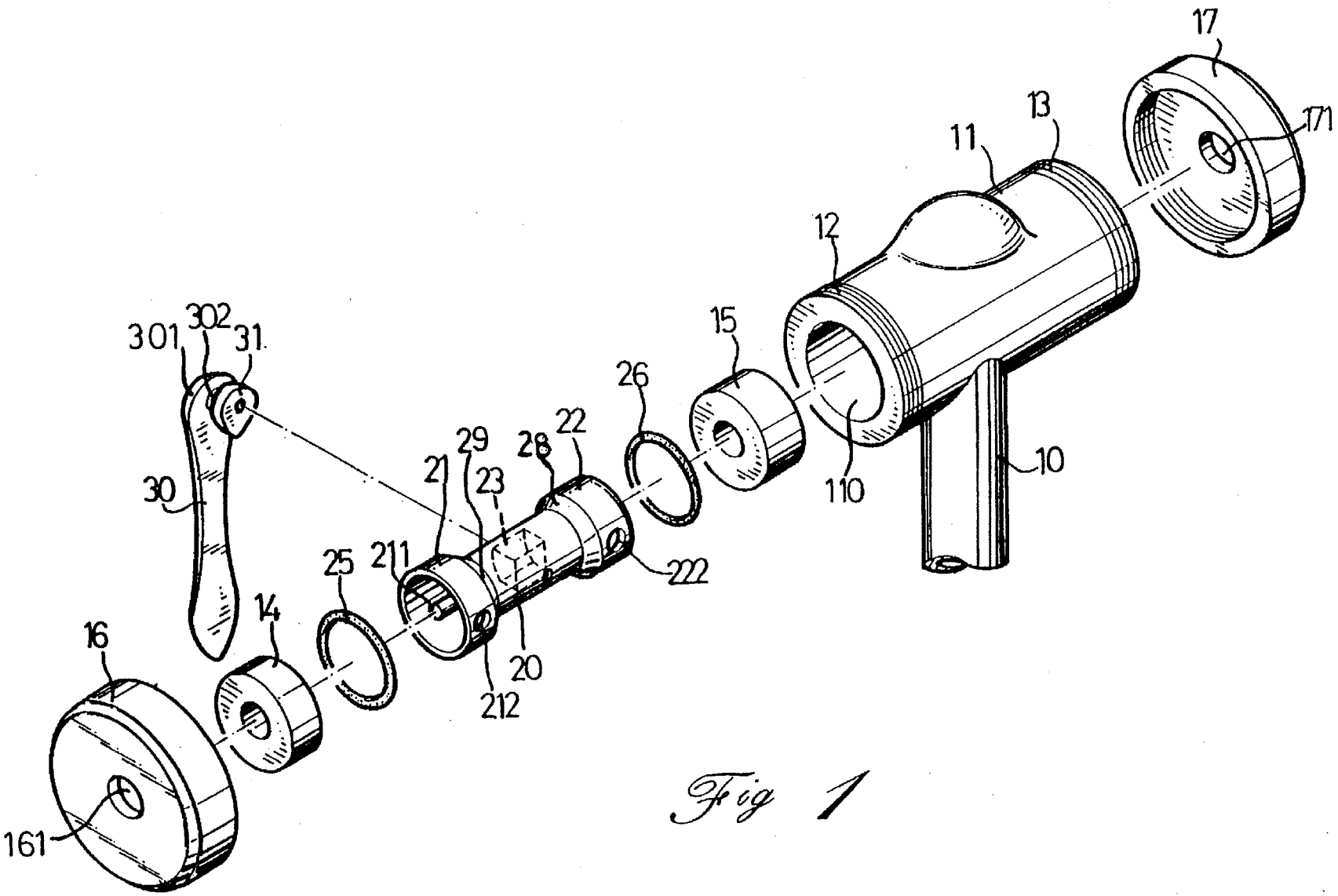
FIG. 1 is an exploded view of a hand pump in accordance with the present invention.
Figure 2:
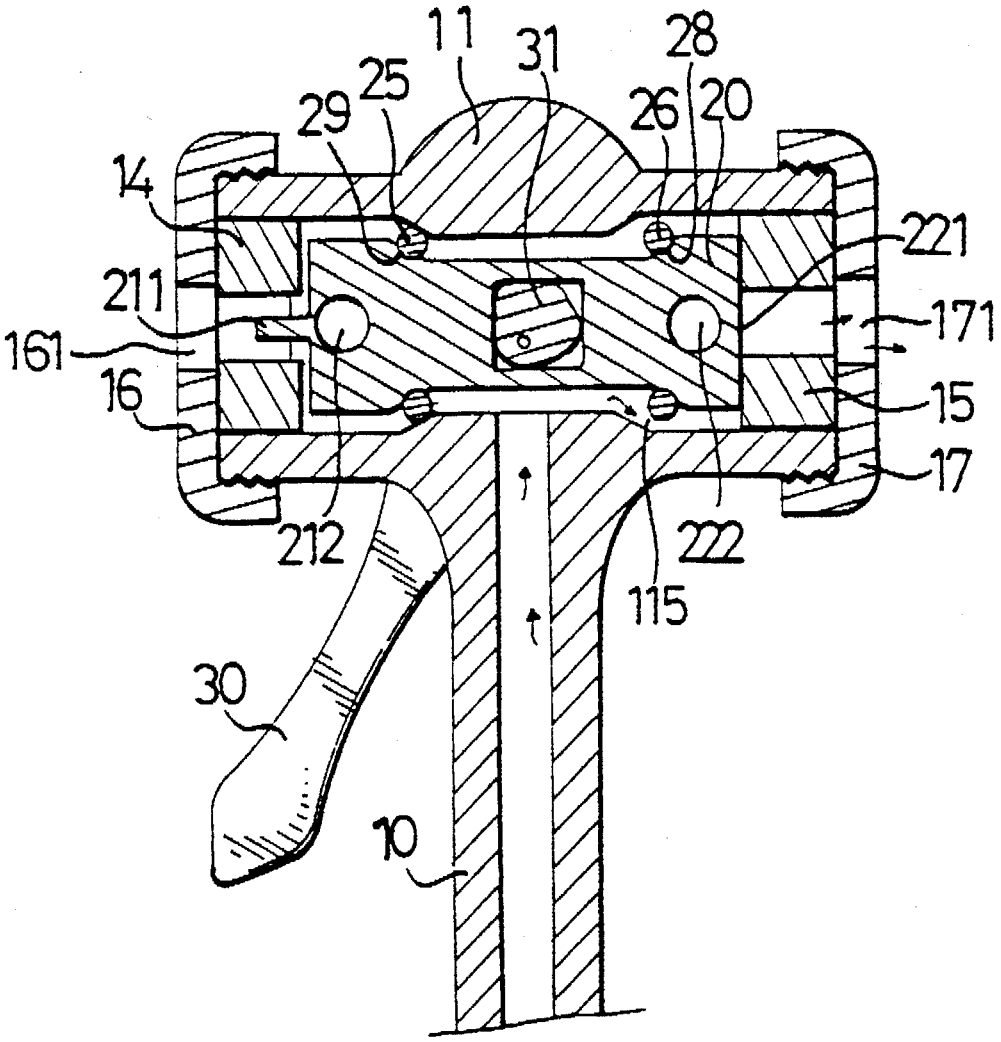
FIGS. 2 and 3 are cross sectional views taken along lines 2—2 of FIG. 4.
Figure 4:
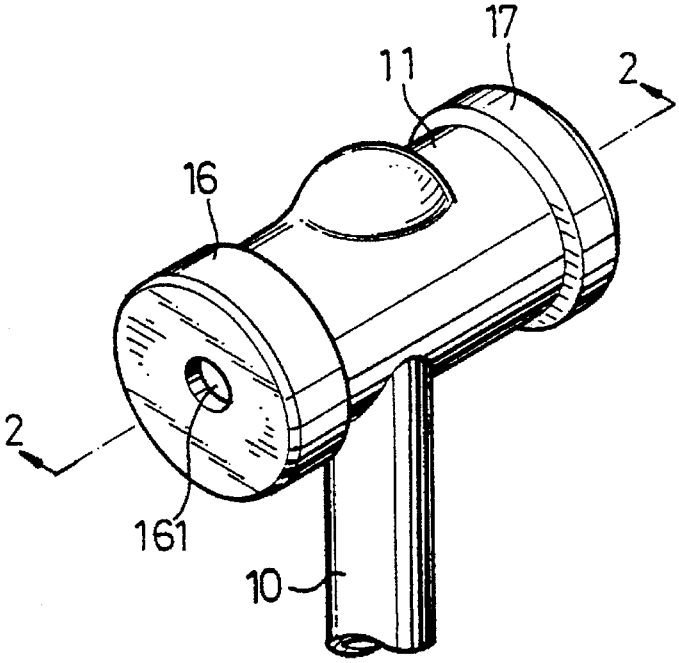
FIG. 4 is a perspective view of the hand pump.

Referring to the drawings, and initially to FIGS. 1, 2 and 4, a hand pump in accordance with the present invention comprises a tube 10 including a pipe 11 laterally secured on top thereof so as to form a T-shaped configuration. The pipe 11 includes two ends each having an outer thread 12, 13 formed thereon for engaging with inner threads of two caps 16, 17 respectively such that the caps 16, 17 may be secured to the end portions of the pipe 11. The caps 16, 17 each includes an opening 16, 17 formed therein for engaging with different tire valves. The pipe 11 includes a bore 10 formed therein for engaging with two gaskets 14, 15 and a plug member 20. A handle 30 includes a shaft 302 laterally extended from the upper portion 301 thereof for rotatably engaging with the pipe 11 and includes a cam 31 secured to the shaft 302. The pipe 11 includes two valve seats 114, 115 formed therein.

The plug member 20 includes two enlarged head portions 21, 22 formed in the end portion and includes a chamber 23 formed in the middle portion for engaging with the cam 31. The chamber 23 has a size that fits the cam 31 and is arranged such that the plug member 20 may be moved longitudinally in the pipe 11 when the cam 31 is rotated. The head portions 21, 22 each includes one or more orifices 212, 222 formed therein and each includes a plug portion 29, 28 for engaging with a sealing ring 25, 26 which are provided for engaging with the valve seats 114, 115 so as to block the air passages to the openings 161, 171 of the caps 16, 17. The plug member 20 includes a projection 211 extended in one of the heads 21 for engaging with one type of tire valves.

Figure 3:
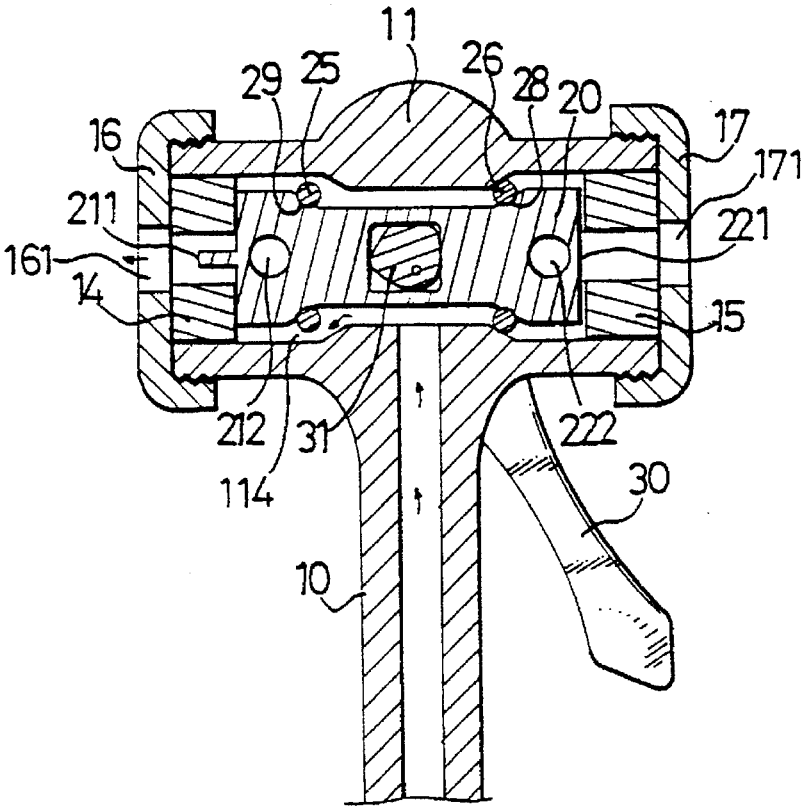

In operation, as shown in FIG. 3, the sealing ring 26 is forced to engage with the valve seat 115 by the plug portion 28 when the plug member 20 is forced leftward by the cam 31 and when the handle 30 is rotated in one direction. At this moment, the valve seat 114 is opened such that air is allowed to flow through the tube 10 and the gap formed between the sealing ring 25 and the valve seat 114 and to flow to the opening 161 via the orifice 212, and such that the hand pump may be provided for pumping a tire valve engaged in the gasket 14.

However, as shown in FIG. 2, when the handle 30 is rotated in a reverse direction, the plug member 20 is forced rightward by the cam 31, such that the sealing ring 25 is forced to engage with the valve seat 114 by the plug portion 29. At this moment, the valve seat 115 is opened such that air is allowed to flow through the tube 10 and the gap formed between the sealing ring 26 and the valve seat 115 and to flow to the opening 171 via the orifice 222, and such that the hand pump may be provided for pumping another type of tire valve engaged in the other gasket 15.

Accordingly, the hand pump in accordance with the present invention may be provided for engaging with different tire valves.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A hand pump for engaging with different tire valves comprising:

a tube including an upper portion having a pipe laterally secured thereon so as to form a T-shaped configuration, said pipe including two end portions, said pipe including two valve seats formed therein, two caps secured to said end portions of said pipe, said caps each including an opening formed therein for engaging with the tire valves, two gaskets engaged in said end portions of said pipe, a plug means slidably engaged in said pipe and engaged between said gaskets, said plug means including two plug portions for engaging with said valve seats of said pipe, and cam means for moving said plug means so as to engage said plug portions with said valve seats.

2. A hand pump according to claim 1, wherein said plug means includes two ends each having an enlarged head portion formed thereon, said plug portions are formed between said head portions and said plug means.

3. A hand pump according to claim 2, wherein said head portions each includes an orifice formed therein for allowing air to flow therethrough.

4. A hand pump according to claim 1, wherein said plug means includes a chamber formed therein, said cam means is engaged in said chamber.

5. A hand pump according to claim 4 further comprising a handle including a first end having a shaft laterally extended therefrom for rotatably engaging with said pipe, said cam means being secured to said shaft and being engaged in said chamber so as to move said plug means when said handle is rotated about said shaft.

* * * * *